United States Patent [19]

Dobney

[11] 4,365,487

[45] Dec. 28, 1982

[54] REFRIGERATION APPARATUS

[75] Inventor: William E. Dobney, Camberwell, Australia

[73] Assignee: Luke Limited, Mitcham, Australia

[21] Appl. No.: 250,321

[22] Filed: Apr. 2, 1981

Related U.S. Application Data

[63] Continuation of Ser. No. 118,885, Feb. 6, 1980, abandoned.

[51] Int. Cl.[3] ..... F25B 1/00

[52] U.S. Cl. ..... 62/498; 62/525; 62/526; 165/179; 165/183

[58] Field of Search ..... 62/498, 435, 525, 526, 62/476; 165/179, 183

[56] References Cited

U.S. PATENT DOCUMENTS

| | | | |
|---|---|---|---|
| 1,788,343 | 1/1931 | Peltier et al. | 62/525 X |
| 2,596,195 | 5/1952 | Arbuckle | 62/526 X |
| 2,669,099 | 2/1954 | Malkoff | 62/525 X |
| 2,740,378 | 4/1956 | Duncan | 62/526 X |
| 2,764,876 | 10/1956 | Parcaro | 62/435 |
| 3,055,642 | 9/1962 | Cox et al. | 62/526 X |
| 3,234,755 | 2/1966 | Richelli | 62/525 |
| 4,183,228 | 1/1980 | Inoue | 62/476 |
| 4,223,539 | 9/1980 | Webb et al. | 62/476 |

FOREIGN PATENT DOCUMENTS

| | | | |
|---|---|---|---|
| 565027 | 10/1944 | United Kingdom | 165/179 |
| 878916 | 10/1961 | United Kingdom | 165/183 |

*Primary Examiner*—Lloyd L. King

*Attorney, Agent, or Firm*—Sughrue, Mion, Zinn, Macpeak & Seas

[57] ABSTRACT

The specification discloses a refrigeration apparatus suitable for cooling water in an air conditioning system, the apparatus having a heat exchanger in which certain heat exchanger tubes are omitted to greatly enhance the overall performance of the apparatus.

17 Claims, 4 Drawing Figures

REFRIGERATION APPARATUS

Figure 1:
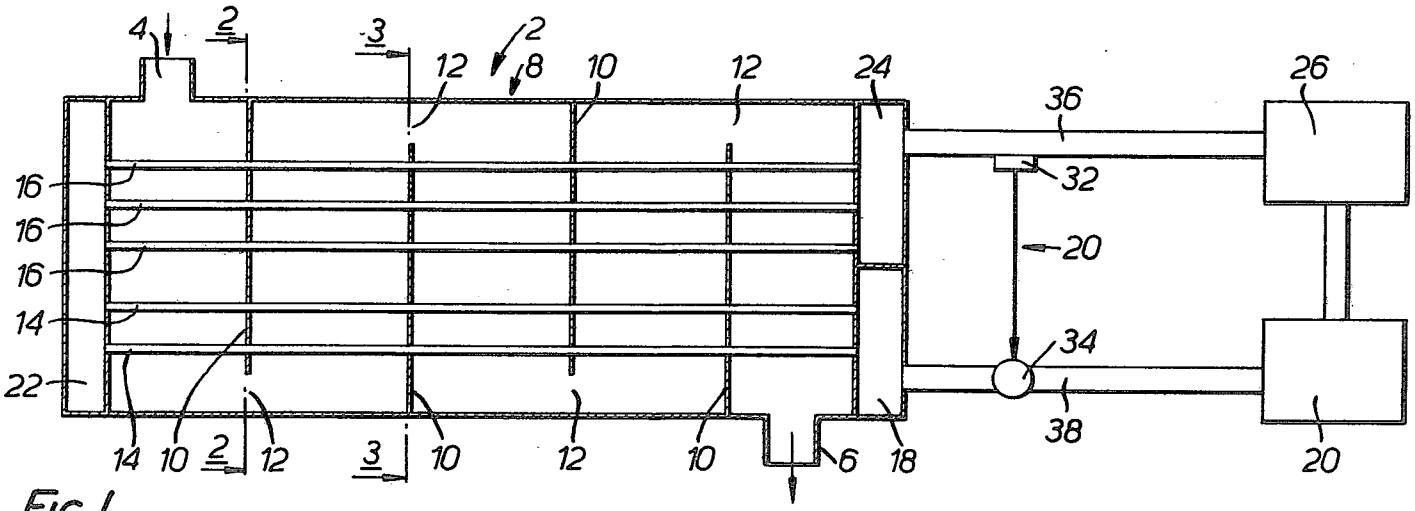

This is a continuation of application Ser. No. 118,885, filed Feb. 6, 1980, now abandoned.

This invention relates to refrigeration apparatus which includes a heat exchanger of the shell and tube type, the heat exchanger being arranged to chill a fluid such as water in an air conditioning system.

In operating refrigeration apparatus of the general type noted above it is important to ensure that the refrigerant in the tubes of the heat exchanger is fully evaporated in the exchanger before being passed to the compressor. Two serious consequences follow from incomplete evaporation of the refrigerant in the heat exchanger. First, any liquid refrigerant which passes to the compressor will be evaporated therein and will seriously affect the efficiency of the apparatus. Second, in the case of a reciprocating piston compressor, serious damage or breakage to the valves of the compressor can be caused by liquid refrigerant being admitted thereto. Accordingly, it is known to sense the state of the refrigerant being returned to the compressor to detect the presence of liquid therein and, generally speaking, the flow of refrigerant in the system is reduced if the refrigerant is not fully evaporated in the heat exchanger. The reduced flow enables the remaining refrigerant to be fully evporated and hence the problems noted above are avoided. Of course, the reduced refrigerant flow correspondingly reduces the available cooling output of the apparatus. It can be seen therefore that the problem of incomplete evaporation of refrigerant seriously affects the performance of refrigeration apparatus.

It is the object of the present invention to provide a novel refrigeration apparatus structure which substantially avoids the problem of incomplete refrigerant evaporation and thus leads to greatly improved efficiency of operation of the apparatus and therefore apparatus of a given size can produce a much greater output than is conventionally available with apparatus of a similar size.

According to the present invention there is provided refrigeration apparatus for cooling a fluid said cooling apparatus comprising a heat exchanger which comprises a shell, tubes for flow of refrigerant through the shell from a refrigerant input to a refrigerant output, baffle means for the shell for defining a tortuous flow path for said fluid through the shell, there being no tubes which lead to the refrigerant outlet in those regions of the shell where the flow path of said liquid has substantial components of velocity in a direction parallel to the tubes, a condenser for supplying liquid refrigerant to said refrigerant input, a compressor for receiving evaporated refrigerant from said refrigerant output and for supplying compressor refrigerant to said condenser, valve means for controlling flow of refrigerant and sensing means for sensing the state of refrigerant at said refrigerant outlet and being operable to control said valve means so as to reduce flow of refrigerant if liquid refrigerant at conditions indicative of the presence thereof is sensed at said outlet.

In the apparatus defined above it is to be particularly noted that there are no tubes which lead to the compressor in the regions of the heat exchanger shell where the flow is generally parallel to the direction of the tubes. Normally this is in the so called "window" area of the baffles since in such areas the effective heat transfer from the fluid to be chilled to the refrigerant in any tubes in the window areas is low and the elimination of those tubes which lead to the refrigerant outlet in the window areas substantially reduces the possibility of liquid refrigerant being returned to the compressor. In contrast, in conventional refrigeration apparatus it is customary to have tubes in the window areas since it is usually the object of designers to take the most advantage of the available space for tubes within the exchanger shell. However, this practice leads to all of the tubes being operated only at the capacity of the most inefficient tubes since the control system which regulates the refrigerant flow operates on the entire flow of refrigerant through the apparatus. In other words because of the refrigerant regulating arrangements which are present, the inefficient tubes effectively reduce the otherwise efficient tubes to the same level as the inefficient tubes.

In the prior art there has been a proposal to construct a shell and tube type heat exchanger which is somewhat similar to the heat exchanger utilized in the apparatus of the invention. In particular U.S. Pat. No. 3,351,131 discloses an arrangement in which tubes are omitted from the window areas on either side of the shell, for the purpose of designing a heat exchanger in which there are known uniform conditions of flow about the tubes in the central region of the shell. This enables vibrational effects of the tubes to be more readily calculated and moreover it is asserted that there is no adverse effect on heat exchange efficiency and indeed it is said that the efficiency increases. It is clear that in this arrangement, the overall heat exchanger efficiency may be regarded as increased since the inefficient tubes are simply removed leaving only those tubes which operate at peak efficiency. In contrast to this, the applicant's refrigeration machine includes regulating apparatus which controls the flow of refrigerant therethrough and the removal of tubes which lead to the compressor in the window areas has the effect not just of removing inefficient tubes but has the effect of enabling the otherwise efficient tubes to operate at their most efficient levels. The techniques of the invention have been demonstrated and found to provide quite staggering advantages. In one test, two similar refrigeration apparatuses were constructed, one having a heat exchanger with 131 tubes having a smooth outer surface and being approximately $\frac{3}{8}''$ in outer diameter, there being approximately 24 tubes located within the window area on either side of the heat exchanger shell. The other heat exchanger was identical except that 24 of the tubes which lead to the compressor were omitted from the window area. Thus the second exchanger utilized 13% fewer tubes but on testing was found to have a capacity approximately 40% greater than the exchanger with the tubes in both window areas. Thus not only is there a cost saving in materials, the resultant apparatus can be rated 40% higher than comparable prior art arrangements.

Further, it has been found that the efficiency of the exchanger can be enhanced even further by using a particular form of tube which has grooves both on its internal and external surface and in such arrangement it has been found that the exchange efficiency is so good that tubes are omitted from both window areas i.e. not just those tubes which lead to the compressor. In such an arrangement it has been found that it is possible to use only approximately 30 tubes whereas in a conventional apparatus of similar capacity 80 to 100 tubes would be required.

Figure 2:
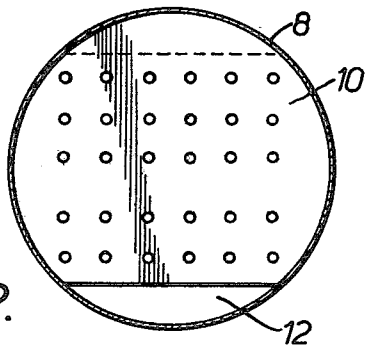
Figure 3:
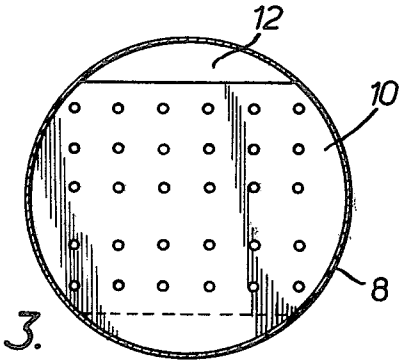
Figure 4:
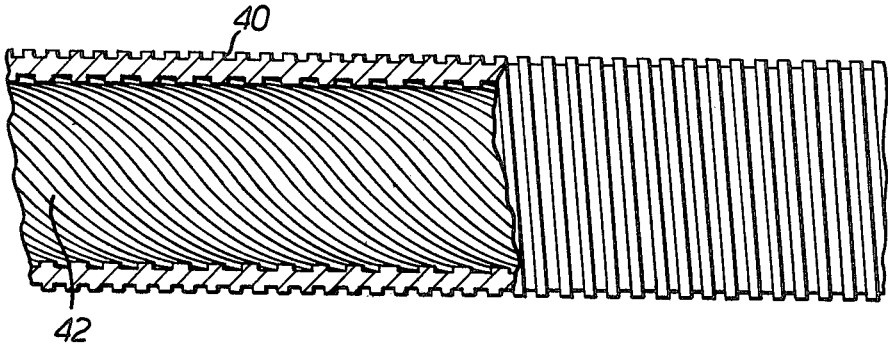

The invention will now be further described with reference to the accompanying drawings, in which:

FIG. 1 is a schematic diagram of refrigeration apparatus constructed in accordance with the invention with the heat exchanger being shown in longitudinal section, FIG. 2 is a cross-sectional view taken along the line 2—2 marked on FIG. 1, FIG. 3 is a cross-sectional view taken along the line 3—3 marked on FIG. 1, and FIG. 4 illustrates the preferred form of profile of tubing for use in the heat exchanger shown in FIG. 1.

The refrigeration apparatus shown in FIG. 1 is suitable for cooling a fluid such as water in an air conditioning system. The water to be cooled enters a heat exchanger 2 via a water inlet 4 and leaves from an outlet 6. The exchanger comprises a shell 8 having a number of baffles 10 therein each baffle including a "window" 12, the windows of adjacent baffles being located on opposite sides of the shell to thereby define a tortuous path between the inlet 4 and outlet 6 for the fluid to be cooled. In addition to defining the tortuous path, the baffles 10 provide support for the refrigerant tubes of the heat exchanger. The illustrated exchanger is a two-pass arrangement in which the tubes 14 of the first pass are located beneath the tubes 16 of the second pass. The tubes 14 of the first pass open to an inlet chamber 18 which in turn is connected to the input of a compressor 26 which receives liquid refrigerant from a condenser 20. At the other end of the exchanger the tubes 14 open into a transfer chamber 22 which also communicates with the ends of the tubes 16 in the second pass. The other end of the tube 16 communicates with an outlet chamber 24 which in turn is connected to the input of a compressor 26 which compresses the refrigerant and supplies it to the condensor 20. In passing through the tubes 14 and 16 the liquid refrigerant loses heat to the surrounding liquid in the heat exchanger shell and ideally of the refrigerant will be evaporated within the tubes so that no liquid refrigerant is present in the outlet manifold 24 and no liquid refrigerant is admitted to the compressor 26. Refrigerant regulating apparatus 30 is provided to control the flow of refrigerant in the apparatus in the event that the apparatus departs from ideal conditions. Generally speaking the purpose of the regulating apparatus 30 is to detect liquid refrigerant or conditions indicative of the presence of liquid refrigerant and reduce the flow of refrigerant through the apparatus to a lower level whereby all of the refrigerant is evaporated in the exchanger, thereby avoiding admission of liquid refrigerant to the compressor 26. This of course reduces the cooling output from the apparatus. The regulating apparatus may include sensing means 32 which is operable to sense the pressure and temperature of refrigerant in the chamber 24 or in the refrigerant conduit 36 leading to the compressor 26. The sensor 32 controls a valve 34 which is located in a refrigerant conduit 38 from the condensor 20 to the inlet manifold 18. The regulating apparatus 30 may comprise a SPORLAN or ALCO thermostatic expansion valve.

It will be noted from FIGS. 2 and 3 that none of the tubes 16 in the second pass are located in the window area 12. In the window areas the flow of fluid in the shell is generally parallel to the direction of the tubes and accordingly heat transfer is low. It has been found that where tubes of the final pass are located in the window area, as is the practice in the prior art, evaporation in such tubes is often incomplete, this being detected by the regulating apparatus and the latter operates to reduce the flow of refrigerant through the whole machine, thus reducing the heat transfer between the surrounding liquid in the shell and all tubes of the exchanger including those which are not located in the window areas. This effect is eliminated in the apparatus of the invention since there are no tubes 16 in the second pass located in the window area.

There may be tubes of other passes which are located in window areas but this depends on the type of tubing used. For instance, where tubes of smooth outer surface are used, it is quite desirable that except for the final pass such tubes be located in window areas since it has been found that for tubes with a smooth outer surface the heat exchange efficiency in the window areas is satisfactory. However, where the tubing is externally grooved as illustrated in FIG. 4, there is little point in locating such tubes in window areas since the effective transfer in such areas is greatly diminished compared to that which is attainable in non-window areas.

The exchanger illustrated in FIG. 2 also includes another novel aspect. This is the non-uniform distribution of tubes between the first and second passes. It is to be noted that the ratio of the number of tubes 14 in the first pass to the number of tubes 16 in the second pass is approximately 2:3. It has been found that by increasing the number of tubes in such manner the overall efficiency of the exchanger is improved when compared with conventional exchangers which normally have equal numbers of tubes in the successive passes.

The particular form of tube illustrated in FIG. 4 has been found to provide most advantageous performance in the apparatus of the invention. The same tube can be used in the first or the second pass. The tube is provided with grooves 40 on its outer surface and grooves 42 on its inner surface. The grooves 40 and 42 are preferably helical and roll-formed into the outer and inner surfaces respectively. Further, the grooves on the outer surface have a pitch in the range of 4 to 10 grooves per centimeter and the grooves on the inner surface have a pitch in the range of 0.1 to 0.2 grooves per centimeter. Generally speaking, heat exchanger tubes having internal and/or external fins or ribs are known and, as discussed in U.S. Pat. No. 4,118,944, the nature of such grooves or fins can significantly affect the heat exchange performance. It is apparent that the prior art does not disclose a heat exchanger tube of the form illustrated in FIG. 4 and the applicant has found that such a tube can most advantageously be utilized in the apparatus of the invention.

Many modifications will be apparent to those skilled in the art without departing from the spirit and scope of the invention.

I claim:

1. Refrigeration apparatus for cooling a fluid, said apparatus comprising:

a heat exchanger having a shell, tubes for flow of refrigerant through the shell from a refrigerant inlet to a refrigerant outlet, baffle means for the shell for defining a tortuous flow path for said fluid through the shell, said tubes which lead to the refrigerant outlet being located only in those regions of the shell where the flow path of said liquid has substantial components of velocity in a direction transverse to the tubes;

a condenser for supplying liquid refrigerant to said refrigerant inlet;

a compressor for receiving evaporated refrigerant from said refrigerant outlet and for supplying compressed refrigerant to said condensor;

valve means for controlling the flow of refrigerant; and sensing means for sensing the state of refrigerant at said refrigerant outlet and being operable to control said valve means so as to reduce flow of refrigerant if a liquid refrigerant or conditions indicative thereof are sensed at said outlet.

2. Apparatus as claimed in claim 1, wherein said shell is elongate and the baffles extend transversely thereof, said tubes being parallel to the shell and passing through each of said baffles, said baffles including openings located on opposite sides of the shell to thereby define said tortuous path.

3. Apparatus as claimed in claim 2, wherein additional tubes are provided which lead from the refrigerant inlet with at least one of said tubes passing through said opening and being provided with a smooth outer surface.

4. Apparatus as claimed in claim 2, wherein the outer surface of said tubes are grooved or provided with fins and wherein each of said tubes pass through each of said baffles.

5. Apparatus as claimed in claim 4, wherein the internal surfaces of said tubes are grooved.

6. Apparatus as claimed in claim 5, wherein the outer surfaces of said tubes have helical grooves the pitch of which is in the range of 4 to 10 grooves per centimeter and the inner surfaces of the tubes have helical grooves the pitch of which is in the range of 0.1 to 0.2 grooves per centimeter.

7. Apparatus as claimed in claim 6, wherein the profile of the grooves on the inner and outer surfaces is rectangular in longitudinal section of the tubes.

8. Apparatus as claimed in claim 1 or 4, wherein said heat exchanger is a multiple path heat exchanger in which refrigerant flows through the tubes in opposite directions in successive passes, transfer chamber means being provided to transfer refrigerant from the ends of tubes of one pass to the inlet tubes of the next succeeding pass and wherein the number of tubes in the final pass is greater than the number of tubes in the first pass.

9. Apparatus as claimed in claim 8, wherein there are two passes, the tubes in the first pass leading from the condensor and the tubes in the second pass leading to the compressor with the ratio of said first pass tubes to said second pass tubes being approximately 2:3.

10. A heat exchanger comprising an elongated shell, an inlet chamber and an outlet chamber located at one end of said shell, transfer chamber means located at the opposite end of said shell, said shell having fluid inlet and fluid outlet means, a plurality of transverse baffles disposed in said shell in spaced apart parallel relation along the length of said shell, each of said baffles having an opening adjacent the side of said shell with the openings in alternate baffles being located at opposite sides of said shell to define a tortuous flow path for fluid passing through said shell from said fluid inlet means to said fluid outlet means, inlet tube means extending from said inlet chamber to said transfer chamber means through said baffles and outlet tube means extending from said transfer chmaber means to said outlet chamber only in those regions of the shell where the flow path of said liquid has substantial components of velocity in the direction transverse to said outlet tube means; each of said tube means having helical grooves in the internal surface thereof.

11. Apparatus as claimed in claim 10, wherein each of said outlet tube means passes through each of said baffle means at a point spaced from said opening in each baffle.

12. Apparatus as claimed in claim 11, wherein at least one of said inlet tube means is provided with a smooth outer surface and passes through said openings in said baffles along one side of said shell.

13. Apparatus as claimed in claim 11, wherein the outer surfaces of each of said tube means passing through each of said baffle means at a point spaced from the openings therein are provided with grooved outer surfaces with said grooves extending substantially parallel to said baffles.

14. Apparatus as claimed in claim 10, wherein the outer surface of said tube means have helical grooves the pitch of which is in the range of 4 to 10 grooves per centimeter and the inner surfaces of the tube means have helical grooves the pitch of which is in the range of 0.1 to 0.2 grooves per centimeter.

15. Apparatus as claimed in claim 14, wherein the profile of the grooves on the inner and outer surfaces is rectangular in longitudinal section of the tube means.

16. Apparatus as claimed in claim 10, wherein said heat exchanger is a multiple pass heat exchanger in which refrigerant flows through said tube means in opposite directions in successive passes, additional transfer chamber means disposed at the end of said shell with said inlet and outlet chambers for transferring refrigerant from the ends of tube means of one pass to the inlet of tube means of the next succeeding pass and wherein the number of tube means in the final pass is greater than the number of tubes in the first pass.

17. Apparatus as claimed in claim 16, wherein the ratio of the number of tube means in the first pass leading from the condensor to the number of tube means in the last pass leading to the compressor is approximately 2:3.

* * * * *